US006269576B1

(12) United States Patent
Williams

(10) Patent No.: US 6,269,576 B1
(45) Date of Patent: Aug. 7, 2001

(54) DISABLEMENT MECHANISM FOR A FIREARM

(75) Inventor: Charles David Williams, Geneseo, IL (US)

(73) Assignee: Springfield, Inc., Geneseo, IL (US)

( * ) Notice: Subject to any disclaimer, the term of this patent is extended or adjusted under 35 U.S.C. 154(b) by 0 days.

(21) Appl. No.: 09/370,532

(22) Filed: Aug. 9, 1999

(51) Int. Cl.[7] ..... F41A 17/02
(52) U.S. Cl. ..... 42/70.08; 42/70.11
(58) Field of Search ..... 42/70.11, 70.06, 42/70.08, 70 F

(56) References Cited

U.S. PATENT DOCUMENTS

| | | | | |
|---|---|---|---|---|
| 689,283 | | 12/1901 | Browning . | |
| 911,683 | | 2/1909 | Scott . | |
| 2,691,232 | | 10/1954 | Hoopes . | |
| 2,803,910 | | 8/1957 | Lyle . | |
| 2,945,316 | | 7/1960 | Mulno . | |
| 2,994,981 | | 8/1961 | Carrigan . | |
| 3,462,869 | | 8/1969 | Wallace . | |
| 4,021,955 | * | 5/1977 | Curtis . | |
| 4,306,487 | * | 12/1981 | Beretta . | |
| 4,312,263 | * | 1/1982 | Bourlet . | |
| 4,575,963 | * | 3/1986 | Ruger et al. . | |
| 4,672,763 | | 6/1987 | Cunningham | 42/70.11 |
| 4,763,431 | | 8/1988 | Allan et al. | 42/70.11 |
| 4,967,502 | * | 11/1990 | Vernon . | |
| 5,081,776 | | 1/1992 | Pack | 42/70.11 |
| 5,081,779 | * | 1/1992 | Pack . | |
| 5,225,612 | | 7/1993 | Bernkrant | 42/70.02 |
| 5,235,763 | | 8/1993 | Nosler et al. | 42/70.11 |
| 5,361,525 | | 11/1994 | Bowes | 42/70.11 |
| 5,517,780 | * | 5/1996 | Haber et al. . | |
| 5,570,527 | * | 11/1996 | Felicci . | |
| 5,581,927 | | 12/1996 | Meller | 42/70.11 |
| 5,625,971 | * | 5/1997 | Tuma et al. . | |
| 5,651,206 | * | 7/1997 | Matarazzo . | |
| 5,666,754 | | 9/1997 | De Oliveira Masina . | |
| 5,671,560 | | 9/1997 | Meller | 42/70.11 |
| 5,680,722 | * | 10/1997 | French et al. . | |
| 5,732,497 | | 3/1998 | Brooks | 42/70.11 |
| 5,749,166 | | 5/1998 | Brooks | 42/70.11 |
| 5,782,028 | | 7/1998 | Simon et al. | 42/70.11 |
| 5,910,003 | | 6/1999 | Kleinpaul | 42/70.11 |

FOREIGN PATENT DOCUMENTS

| | | | |
|---|---|---|---|
| 8904218 | * | 2/1991 | (BR) . |
| 8904218 A | | 2/1991 | (BR) . |

* cited by examiner

*Primary Examiner*—Charles T. Jordan
*Assistant Examiner*—Troy Chambers
(74) *Attorney, Agent, or Firm*—Woodard, Emhardt, Naughton, Moriarty & McNett

(57) ABSTRACT

A mechanism for disabling a firearm is provided. The disablement mechanism includes a body positionable to contact a portion of the hammer spring assembly in order to prevent the hammer from being moved to its cocked position. The disablement mechanism is also positionable to prevent the hammer from firing a cartridge when the hammer is released from its cocked position.

28 Claims, 6 Drawing Sheets

DISABLEMENT MECHANISM FOR A FIREARM

BACKGROUND OF THE INVENTION

The present invention relates generally to the field of firearms, and more particularly to a device for disabling a firearm.

Auto-loading, automatic, and semi-automatic firearms have been in use for many years in the United States and throughout the world. Firearms are used by law enforcement personnel, military personnel, and individuals for various purposes such as, for example, self-defense, target shooting, and sport shooting, to name a few. One of the more popular models for auto loading handguns is found in the commonly referred to Model 1911 .45 caliber handgun (M-1911). Other types of semi-automatic or auto-loading firearms have also become popular over the years and are widely used. Given the availability of these firearms to the general public, one aspect of these firearms that has received much attention and debate over recent years has been the design of safety and locking devices. These devices are designed to prevent the accidental discharge or firing of the weapon.

One example of a design of a safety lock for a handgun is the subject of U.S. Pat. No. 5,081,779 to Pack. This patent describes a safety lock having a cam surface positioned below the bottom end of a shaft of a plunger. The plunger shaft extends through the internal spring. When the safety lock is engaged, the bottom end of the plunger shaft is blocked by the cam surface, thereby preventing the hammer from being cocked. The safety lock also defines a recess coaxial with the plunger shaft when the safety lock is disengaged. The recess allows downward movement of the plunger shaft as the hammer is cocked when the safety mechanism is disengaged. The '779 patent represents just one example of many types of prior art safety devices.

Although there have been many attempts to design safe and effective safety devices for firearms in the prior art, there remains a need for a mechanism that addresses the deficiencies in the prior art devices. For example, many prior art safety devices require substantial modifications to the components of the firearm in order for the safety device to work properly. In addition to substantial modifications to the firearm components, another problem with the prior art safety devices is that substantial modifications must be made to the frame of the firearm in order to accommodate the position of the safety device. Thus, for some safety devices, it is not feasible or even possible to retrofit an existing firearm with the device. Also, some prior art safety devices are comprised of several complex components, dramatically increasing the cost and effort of manufacturing, installing, and using the safety device.

The above describes just a few of the problems that exist with respect to devices designed to facilitate the safe use and handling of firearms. What is needed is a safety device that is enabled and disabled by the user in a safe, efficient and reliable manner. The device should be readily adaptable to installation in a variety of firearms. The device should also be readily adaptable for use in retrofitting an existing firearm, and in the manufacture and design of new firearms. The present invention satisfies these needs, among others.

SUMMARY OF THE INVENTION

The present invention provides a mechanism for a firearm positionable to disable the hammer spring assembly to prevent it from providing the required energy to cause the hammer to strike the firing pin. The mechanism is positionable whether the hammer is cocked or uncocked.

In one aspect of the present invention, an apparatus for firing a cartridge is provided. The apparatus includes a firearm with a hammer that moves between a cocked position and an uncocked position. A hammer spring assembly connects the hammer with a spring that is tensioned when the hammer is cocked. Actuation of a trigger assembly releases the hammer from the cocked position. A disablement mechanism is positionable to contact the hammer spring assembly and prevent the hammer from being cocked, and from being actuated from the cocked position to fire the cartridge.

In one form, the hammer spring assembly includes a hammer strut pivotally connected at one end to the hammer. The hammer spring assembly includes a spring cap positioned on the spring with a head portion having a top surface abutting the opposite end of the hammer strut. The disablement mechanism is positionable in a groove to contact the spring cap to prevent the hammer from being cocked and is also positionable to contact top surface of the spring cap to prevent trigger-actuation of the cocked hammer from firing the cartridge.

In another aspect of the present invention, an apparatus for disabling a firearm is provided. The firearm includes a hammer movable between a cocked position and an uncocked position. A trigger assembly releases the hammer from the cocked position when actuated. A spring for providing energy to the hammer is positioned within a well of a spring housing. A hammer strut is pivotally connected with the hammer at one end has a length extending to an opposite end. A spring cap is positioned on the spring, and the opposite end of the hammer strut abuts the spring cap. A disablement mechanism is received within a bore in the spring housing. The disablement mechanism is movable from a first position where the firearm is enabled to a second position in contact with the head portion of the spring cap to disable the firearm.

In yet another aspect of the present invention, a method for retrofitting a firearm is provided. The method includes providing a firearm having a hammer movable between a cocked position and an uncocked position and a hammer spring assembly connected with the hammer. The hammer spring assembly includes a spring and a first spring cap positioned on the spring within a well of a first spring housing. The hammer spring assembly is disassembled from the firearm. A second spring housing is provided having a well, a bore formed through the housing in communication with the well, and a disablement mechanism in the bore. A second spring cap is provided with a head portion configured for contact with the disablement mechanism. The disablement mechanism is provided and is positionable within the bore of the second spring housing to contact the second spring cap to disable the firearm when the hammer is in either the cocked position or the uncocked position. The firearm is then reassembled with the second spring housing.

In another aspect of the invention, an apparatus for disabling a firearm is provided. The firearm has a hammer movable between a cocked position and an uncocked position. A spring positioned within a well of a spring housing is tensioned when the hammer is cocked. The apparatus includes a spring cap with a head portion connected to the hammer and abutting the top of the spring. A body is received within a bore formed in the spring housing. The body has a length extending between a first end and an opposite second end. The body is movable from a first position where the firearm is enabled to a second position where contact between the body and the head portion of the spring cap disables the firearm.

These and other objects of the present invention will be apparent from the following description of the preferred embodiment.

DESCRIPTION OF THE PREFERRED EMBODIMENT

Figure 1:
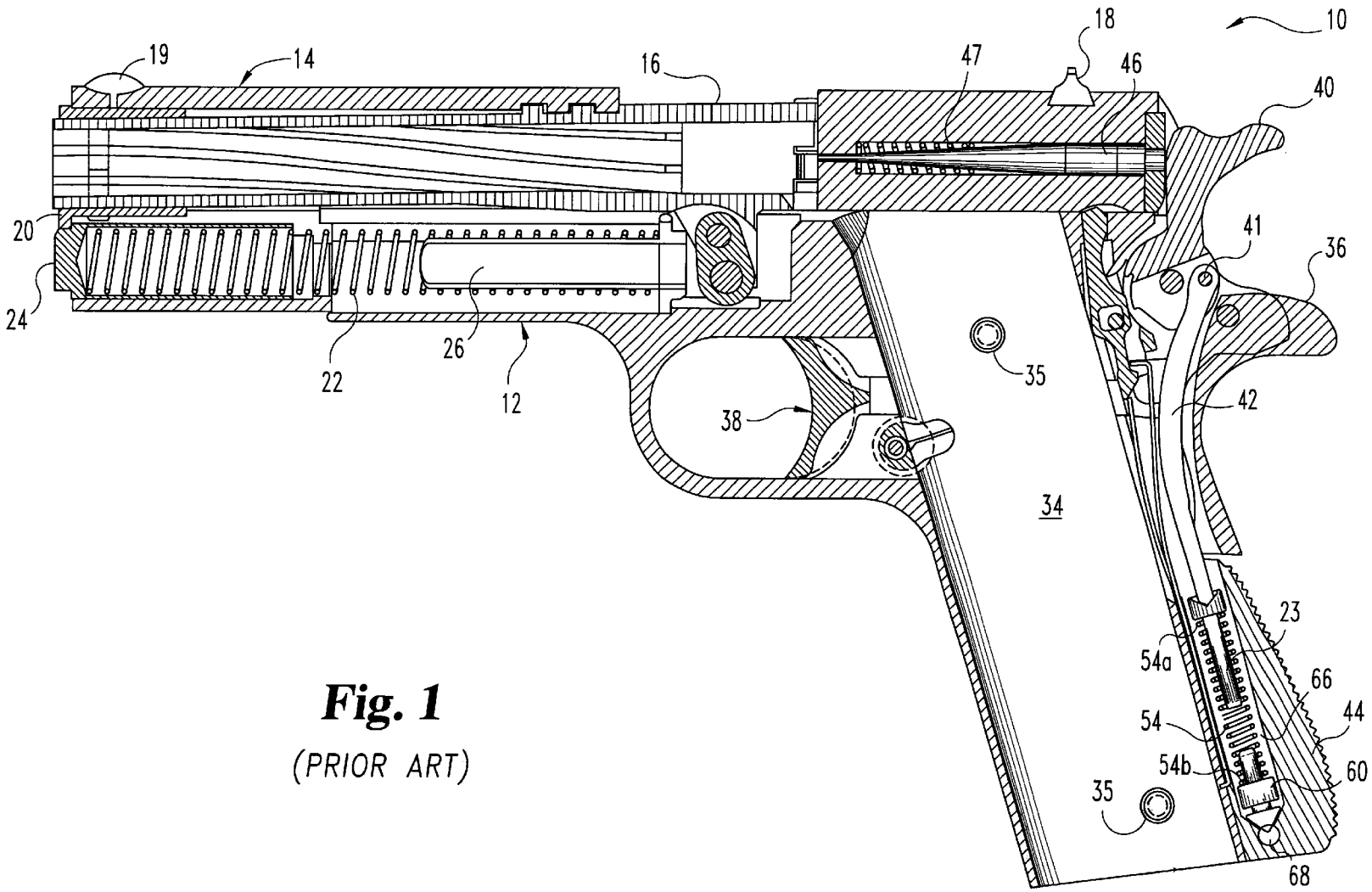
Fig. 1 (PRIOR ART)
FIG. 1 is a partial cross-sectional elevation view of a firearm with its hammer in the uncocked position.

For the purposes of promoting an understanding of the principles of the invention, reference will now be made to the embodiment illustrated in the drawings and specific language will be used to describe the same. It will nevertheless be understood that no limitation of the scope of the invention is thereby intended. Alterations and further modifications in the illustrated device, and such further applications of the principles of the invention as illustrated therein, are contemplated as would normally occur to one skilled in the art to which the invention relates.

Figure 2:
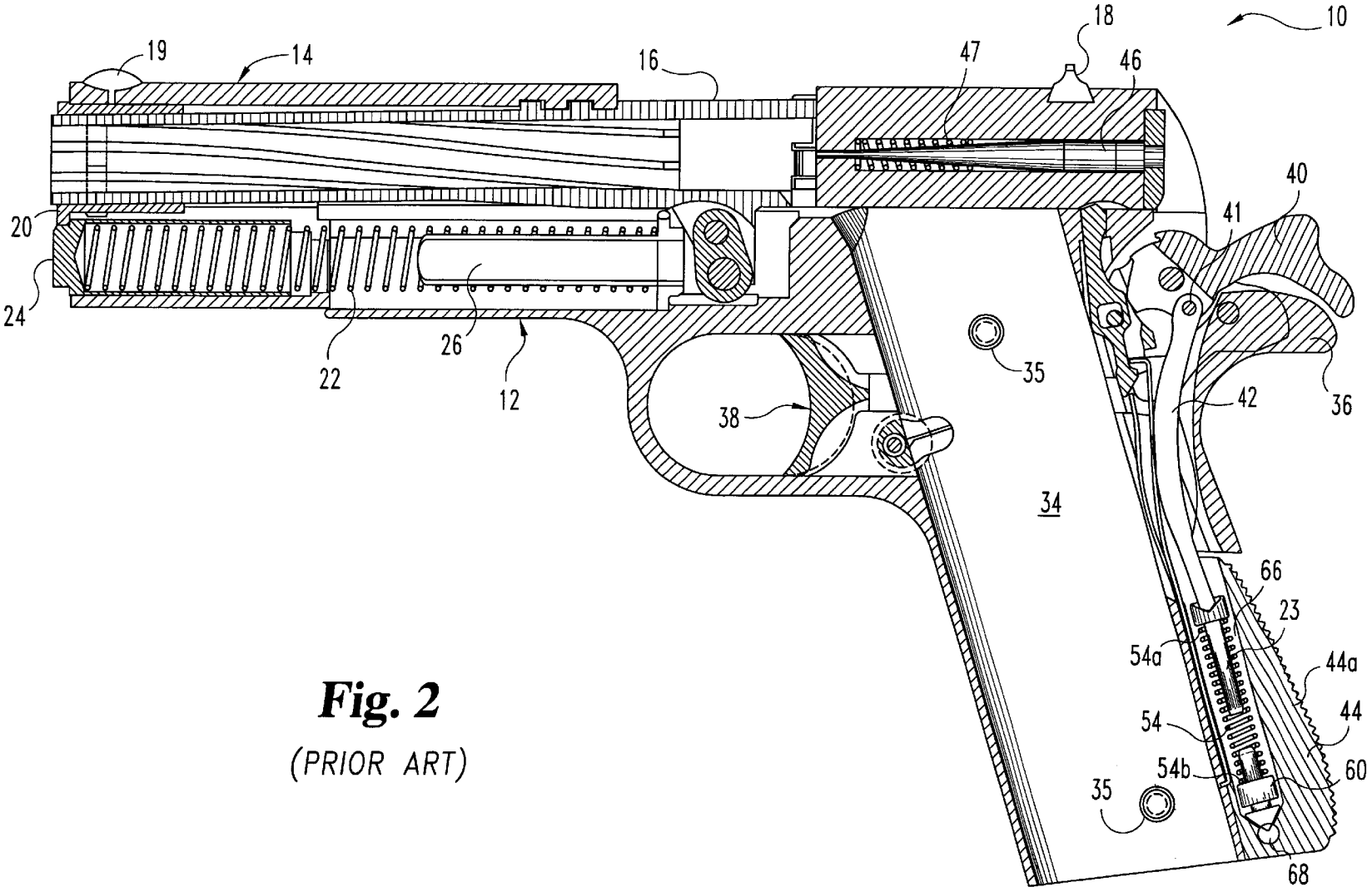
Fig. 2 (PRIOR ART)
FIG. 2 is the firearm of FIG. 1 with its hammer in the cocked position.
Figure 3:
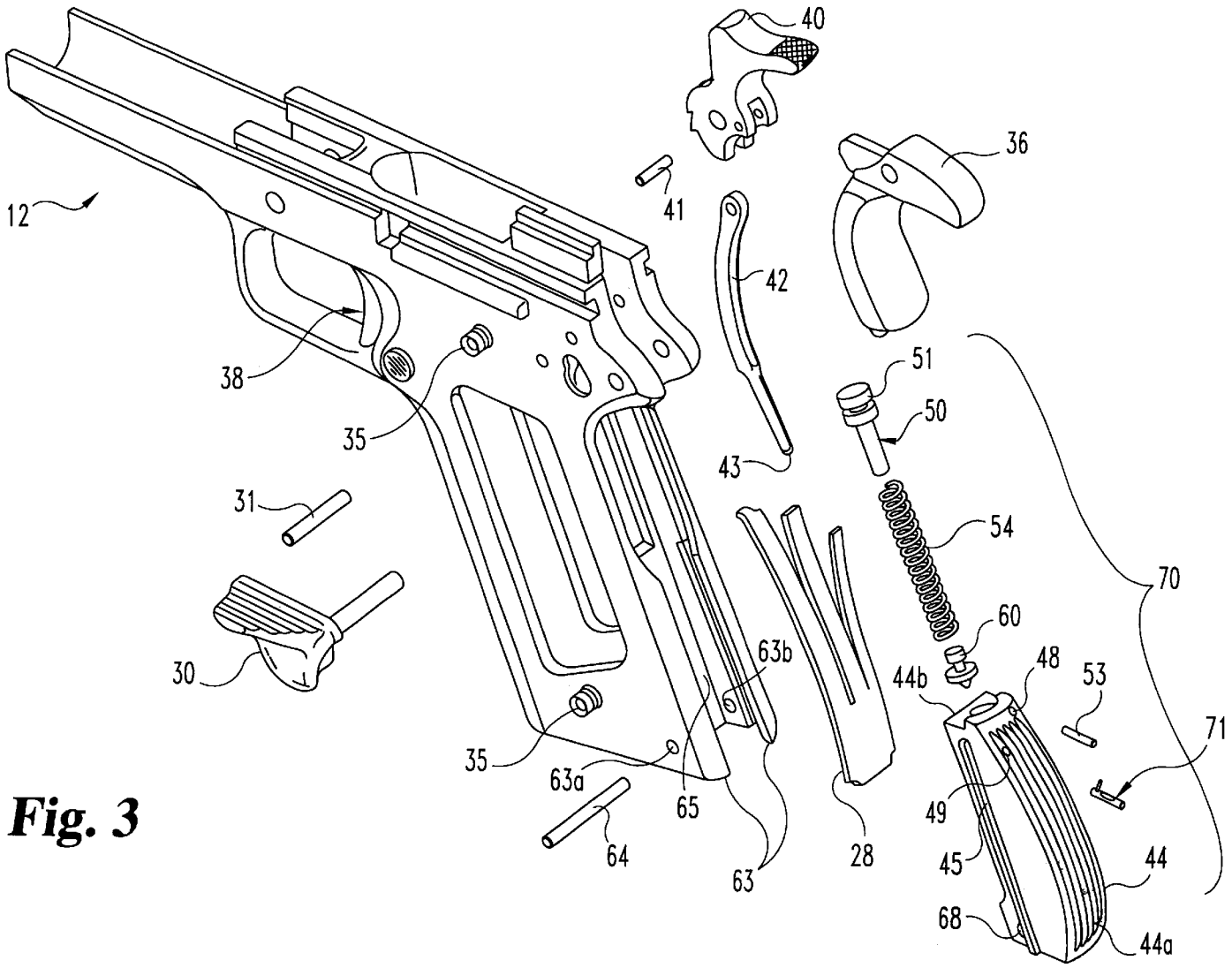
FIG. 3 is a exploded view of a portion of the firearm of FIG. 1 with a disablement mechanism according to the present invention.

Referring now to FIGS. 1–3, there is illustrated various views of a firearm 10 commonly known as the Model 1911 .45 caliber handgun. FIGS. 1–2 are provided to describe generally the components of a type of firearm with which a disablement mechanism 70 may be used. FIGS. 1–2 are also provided to show various operational conditions of the firearm 10. For example, in FIG. 1 the hammer 40 is in the uncocked position, and in FIG. 2 the hammer 40 is in the cocked position. It should be noted that disablement mechanism 70 is not shown in FIGS. 1–2, but rather is shown in FIGS. 3–9.

The environment in which disablement mechanism 70 functions is described herein by general reference to the various components of the Model 1911 handgun. However, it will be appreciated by those skilled in the art that the present invention has application with many types and models of firearms, and no limitation to the scope of the present invention is intended herein by any specific references to the components of the M-1911. Other models of semi-automatic or self-loading firearms may include components that differ from those described with respect to the M-1911; however, the disablement mechanism 70 also has application to such firearms so long as the principles of the present invention are met.

Figure 9:
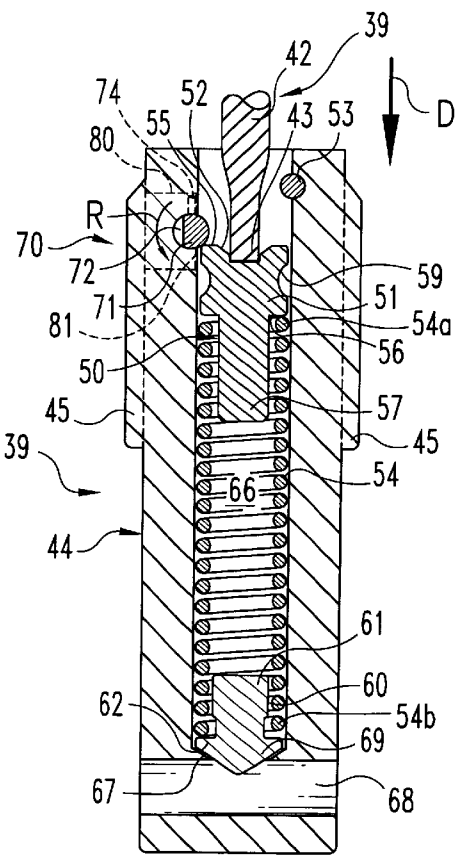
FIG. 9 is the view of FIG. 7 with the disablement mechanism in the engaged position after the hammer has been cocked.
Figure 8:
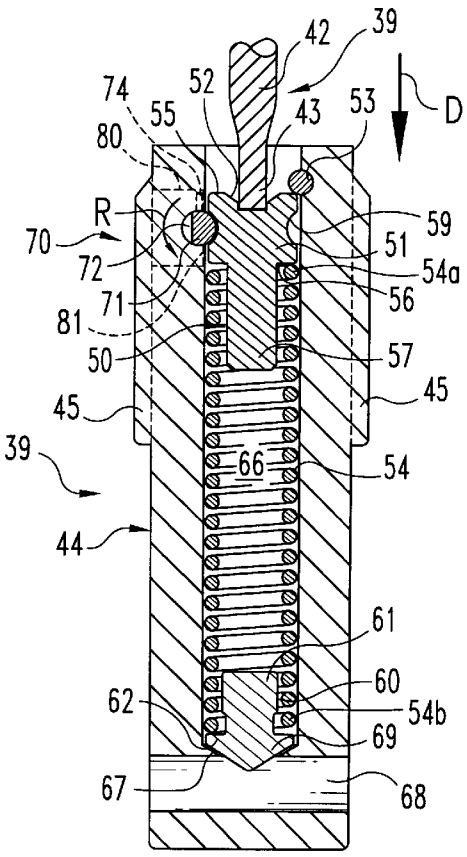
FIG. 8 is the view of FIG. 7 with the disablement mechanism in the engaged position.
Figure 7:
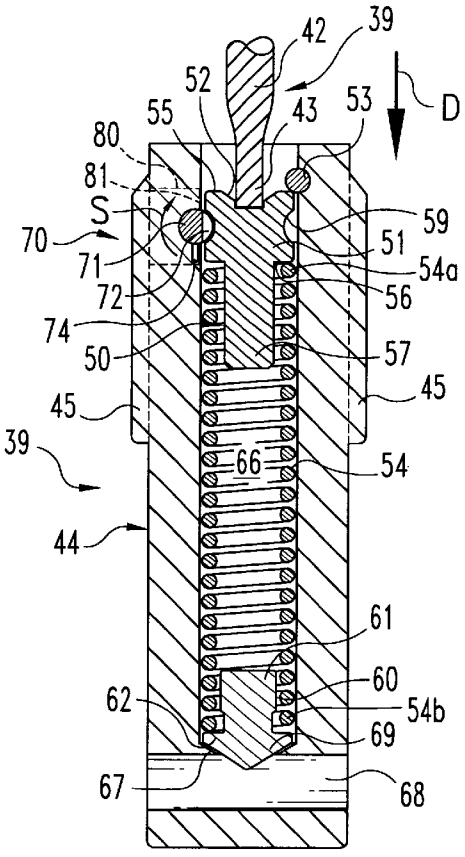
FIG. 7 is a cross-sectional view taken through line 7—7 of FIG. 5 with the disablement position in the unengaged mechanism.

As shown in FIGS. 7–9, the present invention is directed to a disablement mechanism 70 that is positionable to contact a hammer or main spring cap 50 forming part of a hammer spring assembly 39 to disable the firearm 10. When hammer 40 is in the uncocked position, the disablement mechanism 70 is positionable within a groove 59 formed in a head portion 51 of spring cap 50 (FIG. 8.) The hammer 40 is thus prevented from moving from the uncocked position until the disablement mechanism is disengaged as shown in FIG. 7. When the hammer 40 is in the cocked position, the disablement mechanism 70 is positionable to contact a top surface 55 of spring cap 50 (FIG. 9) when the hammer is released from its cocked position. The disablement mechanism 70 prevents main spring 54 from providing the requisite energy to hammer 40 to cause it to strike firing pin 46 with sufficient force to discharge a cartridge upon actuation of the trigger. When disablement mechanism 70 is not engaged (FIG. 7,) hammer spring assembly 39 is free to move with respect to a main spring housing 44.

Referring now to FIGS. 1–2, an example of a firearm 10 usable with the disablement mechanism of the present invention is illustrated. Firearm 10 includes a frame 12 having a slide 14 movably engaged thereto. A barrel 16 is disposed within the slide 14 and extends rearward from the muzzle end of the firearm. A barrel bushing 20 supports and maintains the positioning of the muzzle end of barrel 16, and slide 14 has a rear sight 18 and a forward sight 19 mounted thereon. A recoil spring 22 is positioned around a recoil spring guide 26. The recoil spring 22 is held in position within the slide 14 and frame 12 by plug 24. Disposed near the rearward end of slide 14 is firing pin 46 positioned within a firing pin spring 47. As is well known in the art, firing pin 46 is struck by hammer 40 to fire a cartridge (not shown), which propels a projectile through barrel 16.

Hammer 40 is pivotally connected with frame 12 via hammer pin 31 (FIG. 3) and is connected with a hammer strut 42 by hammer strut pin 41. Hammer strut 42 extends downward from hammer 40 to main spring housing 44. Hammer 40 is pivotable about hammer strut pin 41 between the uncocked position shown in FIG. 1 to the cocked position shown in FIG. 2, as is well known in the art. Hammer spring or main spring housing 44 has a gripping surface 44*a* that contacts the palm of the shooter's hand. Main spring housing 44 also defines a well 66 for receiving a main spring 54. As shown in FIGS. 1–2, a hammer spring or main spring cap 23 is positioned at the upper end 54*a* of main spring 54. Spring cap 23 is in abutting engagement with an end 43 of hammer strut 42. Also positioned within well 66 at the bottom end 54*b* of main spring 54 is a pin retainer 60. Pin retainer 60 contacts the main spring holding pin 64, which extends through pin bore 68 of spring main housing 44.

Firearm 10 also includes grip safety 36 that allows actuation of a trigger assembly 38. As is well known in the art, actuation of trigger assembly 38 releases hammer 40 from the cocked position so it can move from to the uncocked position with energy provided from main spring 54, thus initiating the firing of a cartridge from the firearm 10. On each side of frame 12 are stocks 34 mounted to the frame 12 by stock bushings 35.

Referring now to FIG. 3, there is shown an exploded view of frame 12 of firearm 10 and various components assembled thereto. FIG. 3 differs from FIGS. 1–2, however, in that the disablement mechanism 70 is provided with firearm 10. A spring cap 50 is provided in place of the spring cap 23 shown in FIGS. 1–2. Also, main spring housing 44 includes a bore 49 therethrough to receive the body 71.

A leaf spring 28 is positioned adjacent rearward face 65 of frame 12 between rearward face 65 and main spring housing 44 between inwardly projection portions 63. Main spring housing 44 is secured to the frame 12 with guide rails 45 positioned on either side of main spring housing 44. Guide rails 45 are slidingly received between inwardly projecting portions 63. Main spring holding pin 64 is inserted through apertures 63*a*, 63*b* and through pin bore 68 of main spring housing 44 to connect main spring housing 44 therewith. Firearm 10 also includes a safety lock 30 attached to frame 12 to lock hammer 40 in its cocked position, as is well known in the art.

Figure 4:
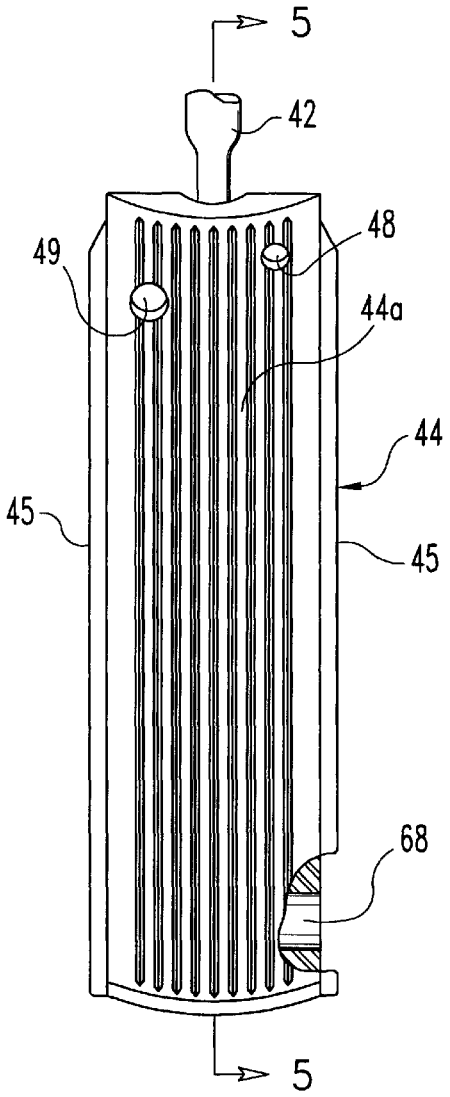
FIG. 4 is a rear elevational view of a portion of the firearm of FIG. 3.

Referring now to FIG. 4, a partially fragmented elevational view of main spring housing 44 along with hammer strut 42 extending therefrom is provided. Main spring housing 44 includes a block bore 48 formed therethrough from gripping surface 44*a* and communicating with well 66. A hammer spring or main spring block 53 (FIG. 3) is inserted through block bore 48 in order to contact top 55 of spring cap 23 or 50 to block main spring 54, spring cap 23 or 50, and retainer 60 within well 66 of main spring housing 44, as shown in FIG. 7. Block 53 is provided to prevent the tension on main spring 54 to cause these components to "jump" out of main spring housing 44 as it is removed from firearm 10. Of course, block 53 permits sufficient upward displacement of main spring 54 to cause hammer 40 to strike firing pin 46 when the trigger is actuated.

Figure 5:
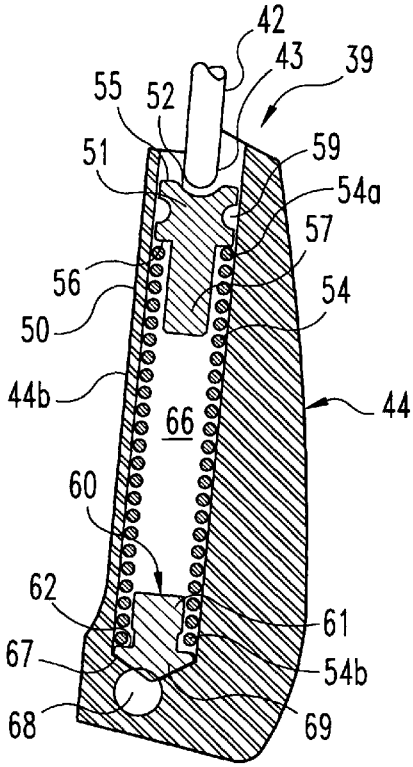
FIG. 5 is a cross-sectional view taken through line 5—5 of FIG. 4.

Referring now to FIG. 5, spring cap 50 includes a head portion 51 extending above and resting upon main spring 54, and a shaft 57 received within main spring 54. Spring cap 50 includes an upper surface 55 having a recessed portion 52. Hammer strut 42 has an end 43 abutting spring cap 50 within recessed portion 52. At the junction of head portion 51 and shaft 57 is a shoulder 56 resting upon upper end 54*a* of main spring 54. Main spring 54 extends downward within well 66 to lower end 54*b* of main spring 54. Pin retainer 60 is positioned at lower end 54*b* of main spring 54. Pin retainer 60 includes an engagement end 69 extending into bore 68. The bottom of well 66 has a tapered portion 67 communicating with pin bore 68. When main spring housing 44 is assembled to frame 12, engagement end 69 is received within tapered portion 67 to contact the outer surface of housing pin 64. Pin retainer 60 also includes shaft portion 61 extending towards spring cap 50 within main spring 54. Main spring 54 rests upon a bearing surface 62 formed between shaft portion 61 and engagement end 69.

Figure 6A:
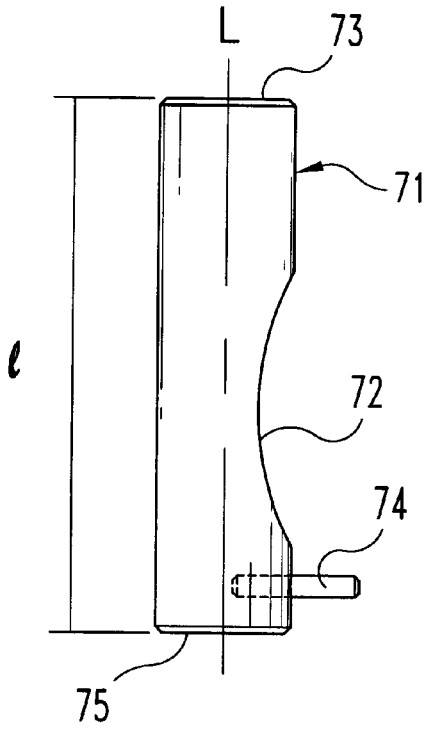
FIGS. 6*a*–6*c* is top, side and end elevation views, respectively, of a component of the disablement mechanism of the present invention.
Figure 6B:
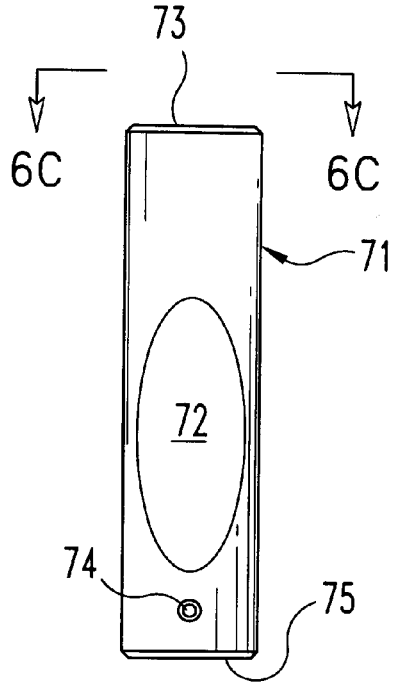
Figure 6C:
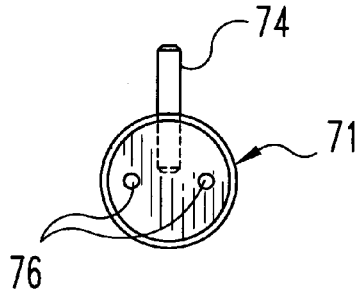

Main spring housing 44 defines a bore 49 for receiving a body 71. Bore 49 preferably extends between gripping surface 44*a* (FIG. 4) and a rearward face 44*b* of main spring housing 44. In a most preferred form, body 71 is cylindrical as shown in FIGS. 6*a*–6*c*, and is rotatably received with the bore 49. As described above, body 71 is positionable within bore 49 to contact spring cap 50 when hammer 40 is in the uncocked position to disable firearm 10. Body 71 is also positionable within bore 59 to disable firearm 10 when hammer 40 is trigger actuated from its cocked position.

Referring now to FIGS. 6*a*–6*c*, body 71 as a length "l" that extends between a first end 73 and an opposite second end 75. Preferably, length "l" is sufficient for body 71 to extend through bore 49 so that first end 73 is aligned with gripping surface 44*a* and second end 75 is aligned with rearward face 44*b*. Body 71 preferably includes threads on its exterior along at least a portion of length "l" so that body 71 may be threadedly received by mating engagement threads formed in bore 49. Other means for retaining body 71 within bore 49 are also contemplated herein. For example, body 71 can be press fit within the bore 49, or body 71 may reciprocate within bore 49, so long as body 71 is positionable to disable firearm 10.

In a most preferred form, first end 73 includes tool engagement openings 76. Tool engagement openings 76 are configured for receiving a tool or key (not shown) for positioning body 71 between a first position where firearm 10 is enabled for firing and a second position where firearm 10 is disabled, as described more fully below. Preferably, body 71 is rotated about its longitudinal axis L within the bore 49. Positioned adjacent second end 75 is a stop 74 extending substantially perpendicular to axis L of body 71. Preferably, stop 74 is press fit into a bore in the body 71, but may also be attached to body 71 by other means, such as, for example, threaded engagement. Stop 74 limits the rotation of block 70 between the positions described below where firearm 10 is enabled and the position where firearm 10 is disabled.

Body 71 defines along a portion of its length L a notch 72. Notch 72 is preferably semi-circular in shape and is dimensioned to conform with to the curvature of well 66 so that when the disablement mechanism is not engaged (firearm 10 is enabled) spring cap 50 is free to move within well 66. It is also contemplated herein that notch 72 has other shapes, such as a rectangular or a triangular shape.

Referring now to FIGS. 7–9, the operation of disablement mechanism 70 to enable and disable firearm 10 and its interaction with components of firearm 10 will now be described. Hammer spring assembly 39 includes hammer strut 42, spring cap 50, and main spring 54. Spring cap 50 includes head portion 51 and shaft portion 57. An upper surface 55 of head portion 51 defines recess 52 for receiving end 43 of hammer strut 42. Head portion 51 also defines shoulder portion 56 resting on end 54*a* of main spring 54. Positioned between upper surface 55 and shoulder 56 is groove 59 extending circumferentially about head portion 51. Groove 59 preferably has a semi-circular cross section allowing body 71 to be rotatably received therein. Preferably, groove 59 has a size and shape substantially corresponding to that of body 71 for a smooth fit therewith.

FIG. 7 shows firearm 10 in an enabled condition with disablement mechanism 70 in a first position. Notch 72 of body 71 is positioned adjacent the spring cap 50. In this position, the hammer spring assembly 39 is free to move downward in the direction indicated by arrow D as hammer 40 is cocked, thus compressing main spring 54 within main spring housing 44. In this first position, disablement mechanism 70 is disengaged and the firearm is enabled, i.e. it may be used as it normally would to fire a cartridge.

In order to disable the firearm when the hammer is uncocked, disablement mechanism 70 is moved to a second position where body 71 extends into spring well 66 as shown in FIG. 8. Body 71 is rotated from its position in FIG. 7 in the direction indicated by arrow S until the position shown in FIG. 8 is achieved, where firearm 10 is disabled. In this position, notch 72 is positioned away from the spring cap 50, and body 71 is received within groove 59 of spring cap 50. The hammer assembly 39 is prevented from moving in the direction of arrow D, and thus hammer 40 is unable to be moved from its uncocked position to its cocked position. Main spring 54 cannot be tensioned to impart the necessary energy to cause the hammer 40 to strike firing pin 46. In order enable firearm 10, body 71 is rotated in the direction of arrow R to its position in FIG. 7.

As shown in FIG. 9, disablement mechanism 70 disables firearm 10 to prevent firing of a cartridge when hammer 40 is trigger actuated. When hammer 40 is cocked, main spring 54 is compressed and upper surface 55 of spring cap 50 is positioned below body 71. To disable firearm 10, body 71 is moved from its position in FIG. 7 to by rotating body 71 about axis L in the direction of arrow S so body 71 extends into spring well 66. In the position of FIG. 9, body 71 contacts upper surface 55 of spring cap 50 to limit upward displacement of spring 54. Disablement mechanism 70 prevents main spring 54 from displacing hammer 40 to its uncocked position. Thus, hammer 40 will not be provided with energy from main spring 54 to strike firing pin 46.

When body 71 is rotated in the direction of arrow S from its unengaged position of FIG. 7 to its engaged positions of FIGS. 8 and 9, and also in the opposite direction of arrow R, stop 74 limits rotational movement of body 71 between these positions. Main spring housing 44 has a recess 80 is formed on rearward face 44*b* of main spring housing 44. As discussed above, body 71 extends through bore 49 so end 75 is flush with rearward face 44*b* with stop 74 positioned within recess 80. Stop 74 contacts vertical wall 81 of recess 80 when either of the desired positions of body 71 is achieved, preventing further rotation of body 71. Thus, stop 71 provides for reliable enablement and disablement of firearm 10 by providing tactile feedback to the person manipulating the disablement mechanism 70 when the desired position is reached.

It is preferred that first end 73 of body 71 be adjacent to or flush with gripping surface 44*a* for easy access and visualization by the user of firearm 10. Tool engagement openings 76 are provided to allow a user possessing the requisite tool or key to rotate body 71 for engagement and disengagement of disablement mechanism 70 as described above. Tool engagement means 76 can assume any one of a number of configurations, such as, for example, a hex opening, an opening for an allen wrench, a square opening, or one or more holes sized and spaced to accommodate a specific type of key. It is also contemplated herein that indicator means be provided on, for example, gripping surface 44*a* so that the user of firearm 10 can have visual confirmation of the status of disablement mechanism 70. For example, tool engagement opening 76 or some other marking on end 73 may be aligned with a green dot when disablement mechanism 70 is engaged, thus indicating the firearm is disabled. When disablement mechanism 70 is disengaged and the firearm is enabled, tool engagement means may be aligned with a red dot. Other types of indicator mechanisms are also contemplated herein as would occur to those skilled in the art.

It is preferred that the components of disablement mechanism 70 have sufficient strength so that, when the gun us disabled, a component of the trigger assembly or hammer strut will fail before the components of disablement mechanism 70. This is particularly important if an unauthorized user attempts to use force to overcome or break the disablement mechanism 70. Disablement mechanism 70 discourages theft of guns because, without the proper tool or key for disengaging the mechanism, disassembly of the firearm 10 is required to return it to an operable condition.

From the foregoing description, it should be apparent that the present invention presents many advantages. Disablement mechanism 70 is simple to use. Also, disablement mechanism 70 is versatile since firearm 10 can be disabled if the hammer is either cocked or uncocked. Disablement mechanism 70 is easily integrated into the design of existing firearms since it requires few additional components and minimum modification to existing firearm components. Disablement mechanism 70 may be sold as part a new firearm 10, or integrated into replacement component to existing firearms. When engaged, the disablement mechanism 70 prevents or deters unauthorized use of the firearm, and protects children who might gain access to the firearm. Given its ease of use and ability to integrate with existing firearms, firearm owners will not be discouraged from using or installing disablement mechanism 70.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. For example, by way of illustration and not limitation, strut 42 of hammer 40 may be modified in such a manner that a safety mechanism 70 would be operable to engage and disengage strut 42 to disable firearm 10.

What is claimed is:

1. An apparatus for firing a cartridge, comprising:

a firearm including a hammer movable between a cocked position and an uncocked position;

a trigger assembly connected with said hammer for releasing said hammer from the cocked position upon actuation of said trigger assembly;

a hammer spring assembly connected with said hammer, said hammer spring assembly including a spring tensioned upon cocking of said hammer to thereafter cause said hammer to fire the cartridge upon actuation of said trigger assembly; and a disablement mechanism positionable with respect to said hammer spring assembly to prevent said hammer from being cocked if in the uncocked position and from being trigger-actuated if in the cocked position.

2. The apparatus of claim 1, wherein said hammer spring assembly includes:

a hammer strut pivotally connected at one end with said hammer and having a length extending to an opposite end; and a spring cap having a head portion positioned on said spring, the opposite end of said hammer strut abutting said spring cap.

3. The apparatus of claim 2, wherein said disablement mechanism is positionable to contact said spring cap to prevent said hammer from being cocked or actuated from the cocked position to fire the cartridge.

4. The apparatus of claim 2, wherein said head portion includes a top surface abutting said opposite end of said hammer strut, an opposite shoulder abutting said spring, and a groove between said top surface and said shoulder.

5. The apparatus of claim 4, wherein said disablement mechanism is positionable within said groove to contact said spring cap when said hammer is in the uncocked position and said disablement mechanism is positionable to contact said top surface of said spring cap when said hammer is released from said cocked position.

6. An apparatus for disabling a firearm, said firearm including a hammer movable between a cocked position and an uncocked position, a trigger assembly connected with the hammer for releasing the hammer from the cocked position upon actuation of the trigger assembly, and a spring positioned within a well of a spring housing, the spring being tensioned upon cocking of the hammer to provide energy to the hammer upon actuation of the trigger assembly, the apparatus comprising:

a hammer strut connected at one end with the hammer and having a length extending to an opposite end;

a spring cap having a head portion positioned on the spring, the opposite end of said hammer strut abutting said spring cap; and a disablement mechanism received within a bore in the spring housing, said disablement mechanism movable from a first position where the firearm is enabled to a second position wherein said disablement mechanism contacts said head portion of said spring cap where the firearm is disabled.

7. The apparatus of claim 6, wherein said head portion includes a top surface abutting the opposite end of said hammer strut, an opposite shoulder abutting said spring, and a groove between said top surface and said shoulder.

8. The apparatus of claim 7, wherein said disablement mechanism includes a cylindrical body having a first end and an opposite second end and a length extending therebetween, said body defining a notch along a portion of said length.

9. The apparatus of claim 8, wherein said body of said disablement mechanism is received within said groove to contact said spring cap when said disablement mechanism is in said second position and the hammer is in the uncocked position.

10. The apparatus of claim 8, wherein said notch is positioned adjacent said spring cap when said disablement mechanism is in said first position and the hammer is in the uncocked position.

11. The apparatus of claim 10, wherein at least a portion of said cylindrical body is threaded and said disablement mechanism is rotatably received within said bore for movement from said first position to said second position.

12. The apparatus of claim 8, wherein said body of said disablement mechanism is positioned within said well to contact said top surface of said head portion when said disablement mechanism is in said second position and the hammer is released from the cocked position.

13. The apparatus of claim 12, wherein said notch is positioned adjacent said well when said disablement mechanism is in said first position and the hammer is in the cocked position.

14. The apparatus of claim 13, wherein at least a portion of said cylindrical body is threaded and said disablement mechanism is rotatably received within said bore for movement from said first position to said second position.

15. The apparatus of claim 6, wherein said disablement mechanism includes a cylindrical body having a first end and an opposite second end and a length extending therebetween, said body defining a notch along a portion of said length, wherein said notch is positioned adjacent said spring cap when said disablement mechanism is in said first position and the hammer is in the uncocked position.

16. The apparatus of claim 15, wherein said first end of said body includes means for engaging a tool for moving said body between said first and second positions.

17. The apparatus of claim 16, wherein said body includes a stop pin extending therefrom adjacent said second end for limiting movement of said body between said first and second positions.

18. A method for retrofitting a firearm, comprising:

providing a firearm having a hammer movable between a cocked position and an uncocked position, and a hammer spring assembly connected with the hammer, the hammer spring assembly including a spring and a first spring cap positioned on the spring within a well of a first spring housing;

disassembling the hammer spring assembly from the firearm;

providing a second spring housing having a well and a bore formed through the housing communicating with the well;

providing a disablement mechanism positionable within the bore;

providing a second spring cap having a head portion configured for contact with the disablement mechanism to disable the firearm when the hammer is in either the cocked position or the uncocked position; and reassembling the firearm with the second spring cap positioned within the second spring housing.

19. An apparatus for disabling a firearm, the firearm having a hammer movable between a cocked position and an uncocked position, and a spring positioned within a well of a spring housing, the spring being tensioned when the hammer is cocked, the apparatus comprising:

a spring cap having a head portion positioned on the spring, the hammer being connected with said spring cap; and a body received within a bore formed in the spring housing, said body having a first end and an opposite second end and a length extending therebetween, said body being movable from a first position where the firearm is enabled to a second position wherein contact between said body and said head portion of said spring cap disables the firearm.

20. The apparatus of claim 19, wherein said body defines a notch along a portion of said length.

21. The apparatus of claim 20, wherein said body is cylindrical.

22. The apparatus of claim 20, wherein said head portion includes a top surface abutting one end of a strut connected at an opposite end to said hammer, said head portion further including an opposite shoulder abutting said spring and a groove between said top surface and said shoulder.

23. The apparatus of claim 22, wherein said body is received within said groove to contact said spring cap when said body is in said second position and the hammer is in the uncocked position.

24. The apparatus of claim 22, wherein said notch is positioned adjacent said spring cap when said body is in said first position and the hammer is in the uncocked position.

25. The apparatus of claim 24, wherein at least a portion of said cylindrical body is threaded and rotatably received within said bore for movement from said first position to said second position.

26. The apparatus of claim 22, wherein said body is positioned within said well to contact said top surface of said head portion when said body is in said second position and the hammer is released from the cocked position.

27. The apparatus of claim 20, wherein said first end of said body includes means for engaging a tool for moving said body between said first and second positions.

28. The apparatus of claim 26, wherein said body includes a stop pin extending therefrom adjacent said second end for limiting movement of said body between said first and second positions.

* * * * *

UNITED STATES PATENT AND TRADEMARK OFFICE

CERTIFICATE OF CORRECTION

PATENT NO. : 6,269,576 B1
DATED : August 7, 2001
INVENTOR(S) : Charles David Williams It is certified that error appears in the above-identified patent and that said Letters Patent is hereby corrected as shown below:

Column 3,
Line 16, please change "is" to -- are --.

Column 4,
Line 51, please change "spring main" to -- main spring --.

Column 7,
Line 7, please insert -- main -- after the word "of".
Line 49, please change "us" to -- is --.

Signed and Sealed this

Sixteenth Day of April, 2002

*Attest:*

*Attesting Officer*

JAMES E. ROGAN
*Director of the United States Patent and Trademark Office*

Adverse Decision In Interference

Patent No. 6,269,576, Charles David Williams, DISABLEMENT MECHANISM FOR A FIREARM, Interference No. 105,018, final judgment adverse to the patentees rendered May 20, 2003, as to claims 1-7, 18, 19.

*(Official Gazette July 29, 2003)*